United States Patent [19]

Nagahori

[11] Patent Number: 4,551,993

[45] Date of Patent: Nov. 12, 1985

[54] NECKLACE WITH SLIDABLY MOUNTED DECORATIVE ELEMENT

[75] Inventor: Morihiro Nagahori, Tokyo, Japan

[73] Assignee: Kabushiki Kaisha Nagahori, Tokyo, Japan

[21] Appl. No.: 661,298

[22] Filed: Oct. 15, 1984

[30] Foreign Application Priority Data

Nov. 2, 1983 [JP] Japan ..... 58-170598

[51] Int. Cl.[4] ..... A44C 25/00

[52] U.S. Cl. ..... 63/31; 63/2; 63/23

[58] Field of Search ..... 63/2, 31, 1, 23

[56] References Cited

U.S. PATENT DOCUMENTS

D. 255,785 7/1980 Bishton ..... 63/31 X 4,034,573 7/1977 · Elkaim ..... 63/31 X 4,237,702 12/1980 Caverly ..... 63/31 X

*Primary Examiner*—F. Barry Shay

*Attorney, Agent, or Firm*—Cushman, Darby & Cushman

[57] ABSTRACT

A necklace which openably closes at clapsed ends meant to be worn centered at the nape of the wearer's neck is provided with a decorative element mounted on a slider which is slidably received on the necklace. The internal transverse sectional profile of the slider at least generally corresponds to the external transverse sectional profile of the chain or strand of the necklace, so that the decorative element always will slide under the influence of gravity to the frontal lowest part of the necklace, but will remain having a facing-outward disposition generally centered heightwise on the chain or strand of the necklace. By preference the chain or strand of the necklace is an elongated flexible element of flattened oval or rectangular transverse sectional shape.

5 Claims, 7 Drawing Figures

NECKLACE WITH SLIDABLY MOUNTED DECORATIVE ELEMENT

BACKGROUND OF THE INVENTION

It is conventional for flexible necklaces of the type which has a clasp at the center of the back to have a pendant, jewelled-element or other decorative element fixed in or to the strand or chain of the necklace at the midpoint between the two clasped ends. Accordingly, when such a necklace is worn with the clasp centered on the nape of the wearer's neck, the decorative element is centered at the front of the wearer's neck or on her or his chest. However, if while wearing the necklace, the person moves in such a way that the necklace becomes rotated somewhat so that the clasp is no longer centered on the nape of the neck, the decorative element becomes correspondingly offset from center. In such a case, the wearer must always be concerned with avoiding such movements as will cause such unsightly angular displacement of the decorative element, or they must constantly attend to rotating the necklace back to its proper disposition or they must settle for sometimes looking as if they were askew.

Of course, on some necklaces, the pendants hang from enlarged loops and so tend to assume a lowest, central position. However, these are different from necklaces where the jewelled element or other decorative element does not hang down, but is superimposed on the line of the necklace itself.

SUMMARY OF THE INVENTION

A necklace which openably closes at clasped ends meant to be worn centered at the nape of the wearer's neck is provided with a decorative element mounted on a slider which is slidably received on the necklace. The internal transverse sectional profile of the slider at least generally corresponds to the external transverse sectional profile of the chain or strand of the necklace, so that the decorative element always will slide under the influence of gravity to the frontal lowest part of the necklace, but will remain having a facing-outward disposition generally centered heightwise on the chain or strand of the necklace. By preference the chain or strand of the necklace is an elongated flexible element of flattened oval or rectangular transverse sectional shape.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

The necklace 1 of the present invention includes an elongated band 2 having the complementary elements of a releasable clasp 4 mounted to its opposite ends. Also provided on the band 2, but usually located about half-way between the ends is a slider-mounted decorative element 3, so that as the band encircles the wearer's neck with the clasp closed and located at the nape of the wearer's neck, the element 3 automatically assumes and maintains a central frontal location where the band 2 hangs lowest. The slider and band are of at least generally corresponding non-circular cross-sectional shape so that the decorative element must maintain its facing-outwards disposition generally centered heightwise on the longitudinal axis of the band.

Figure 2:
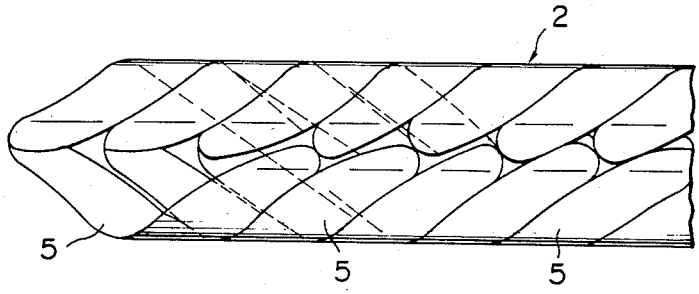
FIG. 2 is an enlarged-scale, fragmentary top plan view of a portion of the flexible chain thereof.
Figure 3:
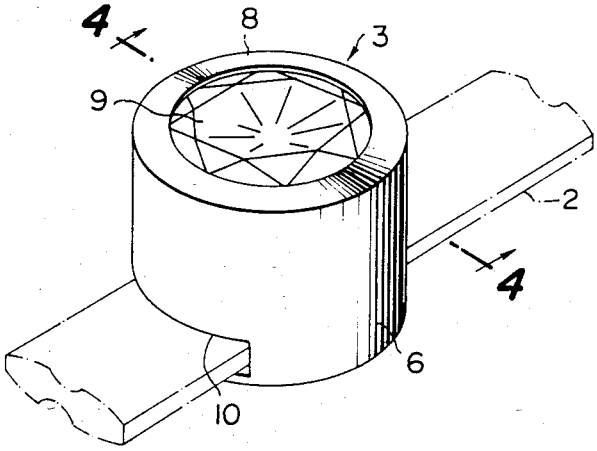
FIG. 3 is an enlarged-scale perspective view of the slider-mounted decorative element thereof, with its disposition in relation to the necklace chain being suggested by phantom lines illustrating a correspnding fragmentary portion of the necklace chain.
Figure 4:
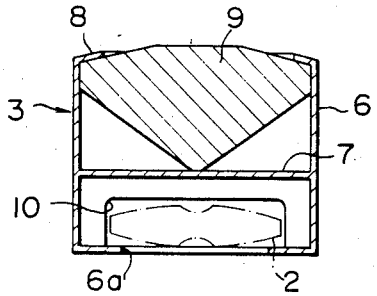
FIG. 4 is a cross-sectional view taken substantially on line 4—4 of FIG. 3.
Figure 5:
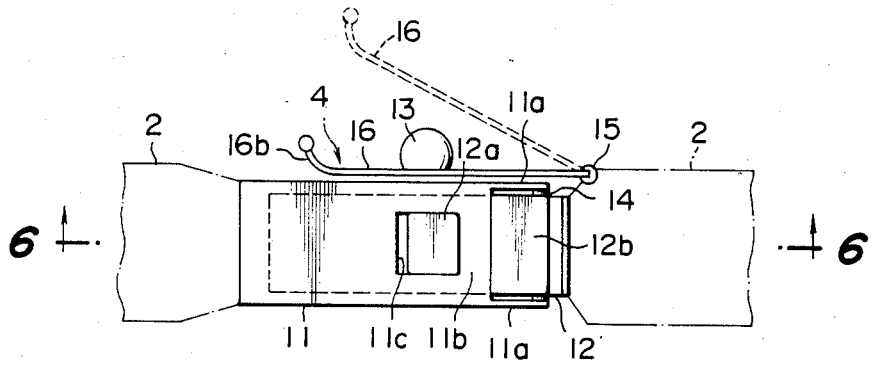
FIG. 5 is an enlarged-scale top plan view of the clasp in a clasped condition, the relation thereof to the corresponding ends of the necklace chain being suggested by phantom lines.
Figure 6:
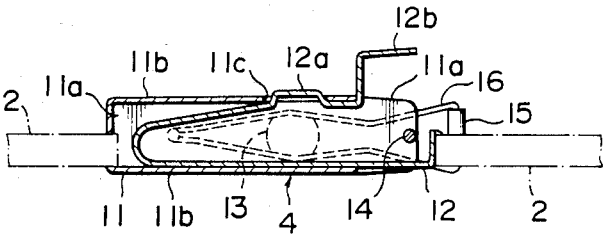
FIG. 6 is a sectional view taken substantially on line 6—6 of FIG. 5.
Figure 7:
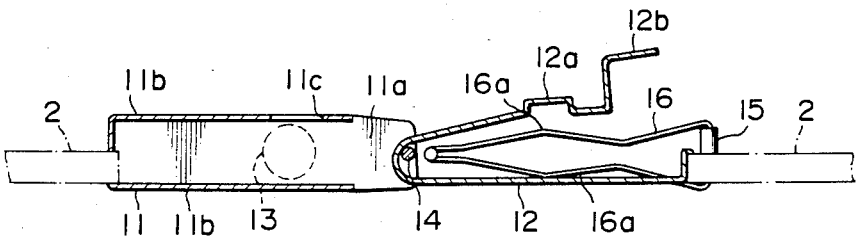
FIG. 7 is a sectional view similar to FIG. 6, but showing the clasp in an unclasped condition, as its two parts are being slid together or are being slid apart.

By preference, the band is of flattened oval or rounded-corner rectangular transverse cross-sectional shape and is constituted by a chain of decorative metal links which is flexible and collapsible, e.g. of the type which is illustrated in FIG. 2. Also by preference, the clasp is of the type which is shown in FIGS. 5–7. The preferred form of the decorative element and its relationship to the band are illustrated in FIGS. 3 and 4.

It is by way of more completely presenting a contemplated best mode that details of the band, clasp and slider mounted decorative element are shown and described. It should be appreciated that, unless otherwise indicated, these details are given by way of example only.

The chain 2 if by preference composed of a plurality of multiple level, bent-rectangular links 5 interlocked in a series so as to cause the band as a whole to be flexible and articulable in the manner of a reptilian or piscine backbone. Such a chain may be generally known in the art as having a "herringbone", "beveled herringbone", "serpentine", "S-link" "snake", "box link", "foxtail", "zipper", "Battuta", "flat cobra", "heart cobra", "C-link", "infinity-link" or "mirrored box-link" pattern or the like. (This list is not meant to be exclusive.)

What is common to the preferred band embodiments is that the band be of sufficiently longitudinally continuous non-spiraling pattern which is non-circular in external transverse cross-sectional shape, that a correspondingly internally shaped slider which is only slightly oversize can slide freely therealong while neither being forced nor permitted to turn angularly of the longitudinal axis of the band, but being constrained to maintain a preselected disposition angularly of that axis, i.e. one which causes the decorative element 3 to be presented towards a person who faces the wearer of the necklace 1.

In the preferred embodiment, the clasp 4 includes complementary releasably engageable members 11 and 12, each secured at its outer end to a respective end of the band 2 and having its inner end constructed and arranged to disconnectably connect with the respective other of said members.

Accordingly, the clasp member 11 is shown provided at its inner end with an open-ended box-like case with left and right plates 11*a* that are longer than its top and bottom plates 11*b*. A rectangular opening 11*c* is shown provided in the upper side plate 11*b* near the open inner end of the case. One of the side plates 11*a* is shown provided on its exterior midway along its length, with a generally spherical, knob-like projection 13 as a keeper for a safety catch. A pin 14 extends laterally between the side plates 11*a* at the open end of the box-like case, beyond the edges of the upper and lower plates 11*b*.

Correspondingly, the clasp member 12 includes a generally U-shaped resilient element having a width that is at least slightly narrower than the space between the left and right side plates 11*a* of the clasp member 11. It is the end of one leg of this U-shaped element which is secured to an end of the band 2; the doubled-back end 12*b* of the opposite leg remains free. The resilient element tapers thicknesswise towards where its two legs merge at a blunt nose, so that at a site located intermediate the blunt nose and the end 12*b*, the free thickness of the clasp member 12 is thicker than the thickness of the space between the upper and lower plates 11*b* of the clasp member 11. Somewhat beyond that site, towards the free end 12*b*, the clasp member 12 upper leg is provided with an upperwardly projecting boss 12*a*, the profile of which as seen in plan (FIG. 5), preferably is similar to but slightly smaller than that of the opening 11*c*.

Accordingly, the clasp 4 can be secured together by hooking the free leg of the clasp member 12 around the bar 14, and then telescoping the clasp member 12 into the case of the clasp member 11 through the open end. The underside of the upper plate 11*b* will resiliently depress the free leg of the catch member 12, until the boss 12*a* registers with and pops-up into the opening 11*c*.

The catch 4 is shown further provided with a safety bail 16 which is pivoted to the same strap end as the catch member 12, e.g. by an upright pintle 15 which may be physically connected with or form a part of the fixed leg end of the catch member 12. The bail is somewhat resilient and the bail sides are bowed at 16*a* sufficiently to permit the bail to be pressed over the safety catch ball 13 in order to snap the safety catch shut. A certain amount of effort is needed in order to open the safety catch by pulling outwards on its free end in order to snap the bail 16 outwards over the ball 13. The bail 16 may be made, e.g. of spring steel, coated to match or complement the decorative state of the band.

In order to release the clasp 4, the person first opens the safety catch by pulling element 16 free of element 13, then while squeezing down on the clasp 12 at the free leg end 12*b*, withdraws the clasp member 12 from the clasp member 11 until the cross bar secondary safety catch 14 comes to engage behind the juncture of the legs of the clasp member 12. Then the nearly free clasp member 12 is turned to unhook it from the cross bar 14.

The slider-mounted decorative element 3 is shown including a generally cylindrical casing 6 having a longitudinal axis and a forwardly-exposed jewel or other ornament 9 set therein and secured in place at one axial end of casing 6, e.g. by being circumferentially surrounded and held down against a base wall 7 by an annular, radially in-turned bezel flange 8. Below the base wall 7 and near the other axial end of the casing, the casing 6 is diametrically slotted at 10 so as provide a tunnel of non-circular transverse cross-sectional shape, at least where it passes through the casing 6 sidewall. Optionally, the back end wall of the casing 6 may be open as shown at 6*a*.

Figure 1:
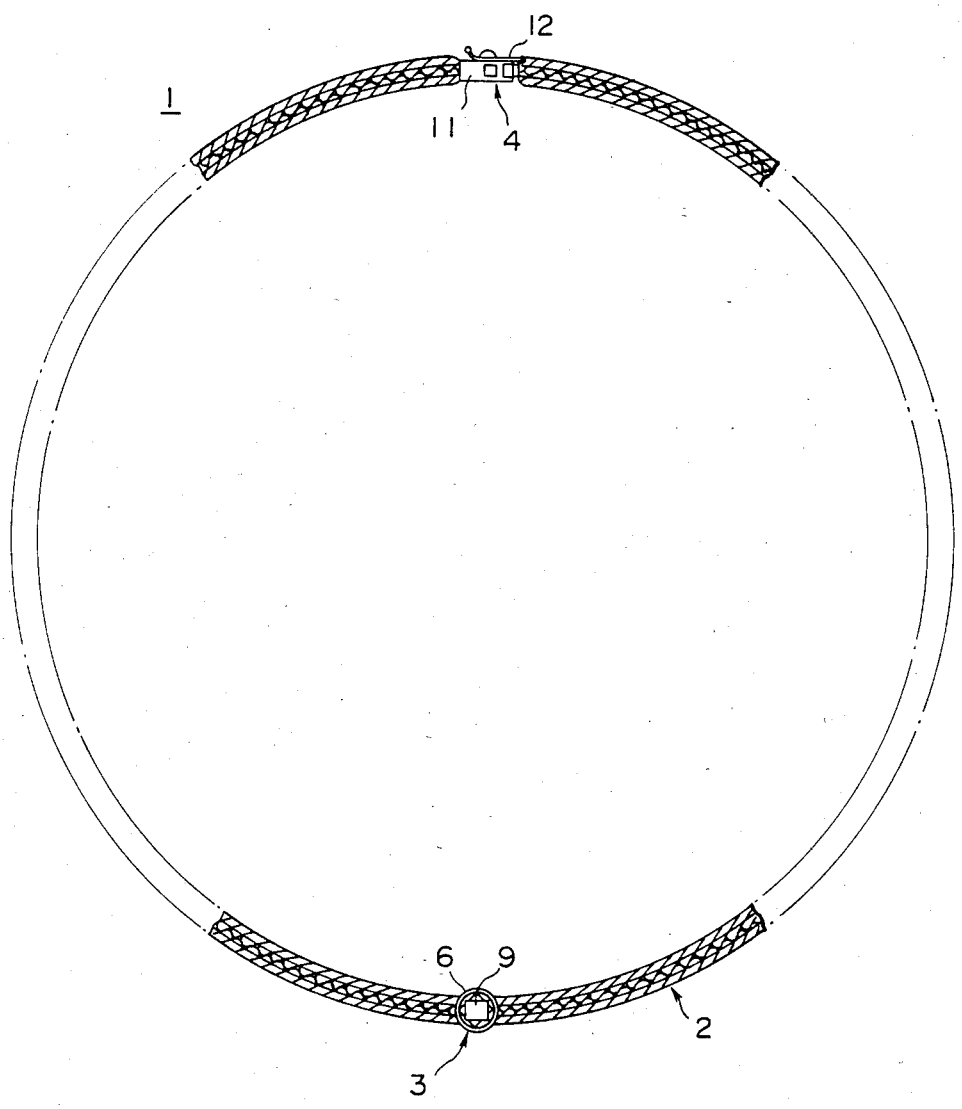
FIG. 1 is a top plan view of a necklace embodying principles of the present invention, with the appearance and structure of some repetitive segments of indeterminate length being suggested by phantom lines.

While the slot means 10 is of similar shape to the transverse cross-section of the band 2, it is slightly larger, i.e. to an extent such as to permit the element 3 to slide freely longitudinally along the band 2, but not to such an extent as would permit the element 3 to rotate significantly angularly about the longitudinal axis of the band 2. Accordingly, the element 3 is free to slide under the influence of gravity to the lowest dip of the necklace band on the wearer's chest, but is constrained to remain generally superimposed, heightwise, on the front of the necklace band and cannot hang down, as a pendant, entirely below the necklace band. Thus if the necklace of FIG. 1 were considered as suspended in a vertical plane, element 3 would slide to the lowest point (as shown) and would remain with its longitudinal axis generally perpendicular to the plane of the band.

The band 2 and casing 6 may be made of any of the precious metals, precious metal-coated base metals, durable metal alloys, plastics, precious metal-coated plastics and the like as are conventionally used in the manufacture of jewelry and costume jewelry. The ornament 9 may be one or more precious stones, semiprecious stones, stone and/or wooden carvings, plastic moldings, precious metal sculptures and the like, such as are used in the manufacture of conventional necklaces. The element 3 may be substantially different in appearance from the example which is depicted.

It should now be apparent that the necklace with slidably mounted decorative element as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A necklace comprising:

an elongated necklace band which is constructed and arranged to be looped about a wearer's neck so as to at least generally encircle the wearer's neck and hang down in front over the wearer's chest;

said elongated necklace band effectively having a non-circular transverse cross-sectional shape, at least throughout a portion of substantial longitudinal extent located where the elongated necklace band will hang down in front over the wearer's chest; and a slider-mounted decorative element means including a casing having a longitudinal axis and a forwardly-exposed ornament;

said casing having means securing said forwardly exposed ornament thereto at one axial end of said decorative element means, and means defining a slot laterally therethrough behind said forwardly-exposed ornament adjacent the other axial end of said decorative element means;

said slot means, at at least one site along the length thereof being transversely of generally similar non-circular cross-sectional shape to said portion of said elongated necklace band, while being sufficiently larger in transverse cross-section as to permit the slider-mounted decorative element means to slide freely longitudinally along said portion of said elongated necklace band so as to be automatically self-centering under the influence of gravity, but being insufficiently larger in transverse cross-section to permit said slider-mounted decorative element to rotate significantly angularly of the longitudinal axis of said elongated necklace band;

said decorative element means being so constructed and arranged with respect to said band that when the necklace is worn with one surface of said band portion facing the wearer's chest and with said band portion lying generally in a plane, said decorative element means projects outwardly from the opposite surface of said band portion with said longitudinal axis generally perpendicular to said plane;

said ornament being thereby superimposed upon said elongated necklace band so as to falsely appear to be mounted to said elongated necklace band by interposition of said casing in said elongated necklace band.

2. The necklace of claim 1, wherein:

said elongated necklace band comprises a series of chained-together links forming a flexible band.

3. The necklace of claim 2, wherein:

said band is formed so as to have two opposite ends;

each said band end being provided with a clasp member secured thereto;

said clasp members being constructed and arranged to be releasably clasped together.

4. The necklace of claim 1, wherein:

the necklace band is of generally rounded-corner rectangular transverse cross-sectional shape so as to present a flattened appearance as worn by the wearer.

5. The necklace of claim 1, wherein:

said slider mounted decorative element means includes a generally cylindrical casing having said ornament exposed through a front end opening thereof, and said slot means is provided by diametrically opposed slots formed through said casing behind said ornament.

* * * * *